United States Patent [19]

Nordlof

[11] Patent Number: 4,773,610

[45] Date of Patent: Sep. 27, 1988

[54] APPARATUS FOR FEEDING STRIP MATERIAL FROM COIL STOCK

[76] Inventor: Richard D. Nordlof, 3312 Crest Road, Rockford, Ill. 61107

[21] Appl. No.: 145,038

[22] Filed: Jan. 19, 1988

[51] Int. Cl.[4] ..... B21C 47/22; B65H 49/00

[52] U.S. Cl. ..... 242/78.6; 242/105; 242/128

[58] Field of Search ..... 242/78.6–78.8, 242/79, 105, 129, 54 R, 128, 55.54

[56] References Cited

U.S. PATENT DOCUMENTS

| | | | |
|---|---|---|---|
| 1,465,818 | 8/1923 | Gunn . | |
| 2,658,694 | 11/1953 | Koch . | |
| 3,136,496 | 6/1964 | McMartin . | |
| 3,162,394 | 12/1964 | Culpepper et al. . | |
| 3,381,913 | 5/1968 | Bachman . | |
| 3,575,358 | 4/1971 | Manner | 242/105 |
| 3,810,591 | 5/1974 | Haven | 242/78.6 |
| 3,815,837 | 6/1974 | Guthrie | 242/78 X |
| 4,249,705 | 2/1981 | Brooks et al. . | |
| 4,290,561 | 9/1981 | Satzinger | 242/78.6 X |
| 4,290,563 | 9/1981 | Brooks et al. . | |
| 4,304,370 | 12/1981 | Box et al. . | |
| 4,578,621 | 3/1986 | Nordlof . | |
| 4,582,271 | 4/1986 | Takahashi | 242/78.6 X |
| 4,610,408 | 9/1986 | Box et al. | 242/78.6 |
| 4,667,897 | 5/1987 | Burrow et al. | 242/129 |

*Primary Examiner*—Stuart S. Levy
*Assistant Examiner*—Steven M. duBois
*Attorney, Agent, or Firm*—Vernon J. Pillote

[57] ABSTRACT

A vertical axis coil stock feed apparatus having a turntable rotatable about an upright axis for rotatably supporting coil stock with the coil axis upright. An arm is mounted on a post alongside the turntable for vertical adjustment relative thereto and a coil cover is rotatably mounted on the arm above the turntable for engagement with the upper end of the coil. A stationary coil shroud is also mounted on the arm with coil retainers extending downwardly at spaced locations around the periphery of the coil cover to limit radial expansion of the coil windings. The arm, together with the coil cover and shroud supported thereby, is power operated between lower and raised positions, and a limit switch is operated when the coil cover engages the upper end of the coil stack to stop downward movement of the arm.

14 Claims, 3 Drawing Sheets

38
91
37
6
6
43
42
41
36
72
57
71
73a
48
73
45
53
52
51
82
51a
C
35
92
39
P
47
15
10
46
34

93
55
61
62
58
36
56
55
57
53
72
73b
78
73b
59
52
51
51a 37
35
41
42
43
45
48
81
37

Fig. 9.
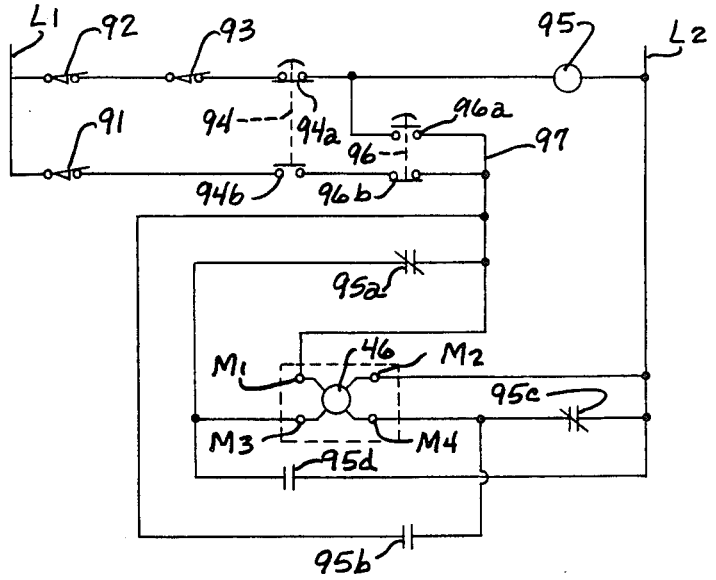
Fig. 7.
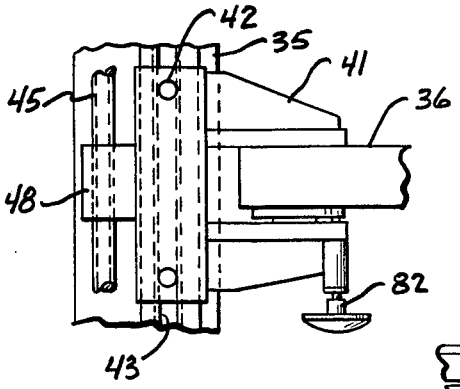
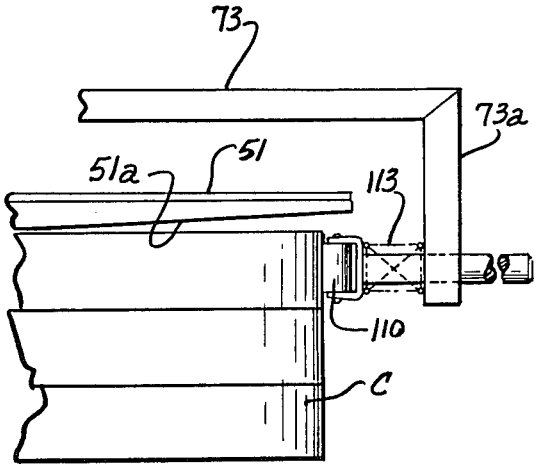
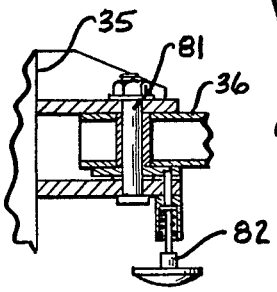
Fig. 10.
Fig. 8.

APPARATUS FOR FEEDING STRIP MATERIAL FROM COIL STOCK

PRIOR ART

Apparatus have heretofore been made for feeding strip material from wound coil stock, in which the stock coil or coils are mounted on a turntable with the coil axis upright. Some vertical axis coil stock feed apparatus provide a turntable supported for unwinding rotation in response to pulling on the stock exerted by stock feed rolls or by the feed mechanism of a stock processing machine. Other vertical axis coil stock feed apparatus provide a power drive for the turntable to drive the stock coil in an unwinding direction at a speed to meet the requirements of the subsequent stock processing machine. The rate of withdrawal of stock withdrawal by the processing machine is frequently not constant but rather intermittent or stepped fashion and, if the instantaneous speed of stock withdrawal is less than the peripheral speed of the outer winding of the stock coil, the inertia of the stock coil and turntable can cause the outer winding or windings of the coil to become loose and displaced either or both radially and vertically relative to the coil. This problem is aggravated when multiple coils are stacked end to end on the turntable, not only because of the increased weight, but also due to the change in level of the coil that is being unwound with relation to the subsequent stock guiding and processing machinery.

Some vertical axis coil stock feed apparatus such as disclosed in U.S. Pat. Nos. 1,465,818; 2,658,694 and 3,381,913 provide a stationary guard or shroud on the base that extends upwardly around the periphery of the coil to control radial expansion of the coil. However, such arrangements make it difficult to load coil stock onto the turntable and are not satisfactory for vertically stacked coil feed apparatus where the stock is withdrawn only from the uppermost coil. U.S. Pat. No. 1,465,818 also provides a cross bar 16 that overlies the top of the coil. While such a cross bar would aid in retaining the outer wrap of the coil against upward movement, it complicates the problem of installation of the coil onto the turntable and, since the cross bar is stationary, it can also cause damage to the edge of the coil stock as the coil is rotated and the end winding unwound from the coil.

Some vertical axis coil stock feed apparatus such as disclosed in U.S. Pat. Nos. 3,136,496 and 3,162,394, provide a rotary shroud or guard that extends upwardly around the coil to control radial expansion of the coil. However, it is necessary to elevate the coil stock as it is unwound from the coil to a level above the rotating guard or shroud and, in these patents, the coil stock is withdrawn from the inside of the coil and guided upwardly and over the coil and shroud.

In U.S. Pat. Nos. 4,249,705; 4,290,563 and 4,304,370, a tool or roller is engaged with the outermost winding of the coil and will operate to confine the outermost winding of the coil against radial expansion, so long as it is maintained in firm engagement with the next winding with sufficient force to overcome the tendency of the coil to clock spring or expand. However, since the tool or roller is in pressurized engagement with the outer winding, deformation of the face and/or edge of the winding can occur, particularly in soft and light weight materials.

SUMMARY OF THE INVENTION

It is an object of the present invention to provide a vertical axis coil stock feed apparatus having an improved arrangement for controlling movement of the outer winding at the upper end of coils or coil stacks of widely different height.

Another object of this invention is to provide a vertical axis coil stock feed apparatus in accordance with the foregoing object, and which minimizes deformation or damage to the coil stock as it is unwound from the coil.

Still another object of this invention is to provide a vertical axis coil stock feed apparatus which is arranged to facilitate loading of the coil on the turntable and to facilitate adjustment of the feed apparatus to coils of different height.

Accordingly, the present invention provides apparatus for feeding strip material from wound coil stock to a processing station which apparatus includes a base and a turntable mounted on the base for rotation about a vertical axis to support coil stock with the coil eye upright. A support post is mounted on the base and extends upwardly therefrom at a location outwardly of the turntable and an arm is mounted on the support post for vertical adjustment relative to the base and is adapted to extend from the post above the turntable. A coil cover is mounted on the arm for rotation relative thereto about a vertical axis generally coaxial with the turntable axis and adapted to engage an upper end of the coil stock on the turntable for limiting upward movement of coil windings, and a stationary coil shroud is mounted on the arm and has means extending downwardly to a level below the coil cover for limiting radial movement of coil windings.

The coil cover is preferably supported for limited vertical movement relative to the arm to yieldably engage the upper end of the coil stock on the turntable. The arm is advantageously vertically adjusted by power operated means responsive to vertical movement of the coil cover relative to the arm.

BRIEF DESCRIPTION OF THE DRAWINGS

FIG. 7 is a fragementary view taken on the plane 7—7 of FIG. 1 on a larger scale than FIG. 1;

FIG. 8 is a fragmentary vertical sectional view taken on the plane 8—8 of FIG. 1;

FIG. 9 is a schemmatic electrical diagram for the over arm control circuit for the vertical axis stock decoiler; and FIG. 10 is a fragmentary view illustrating a modified form of shroud.

DETAILED DESCRIPTION

Figure 1:
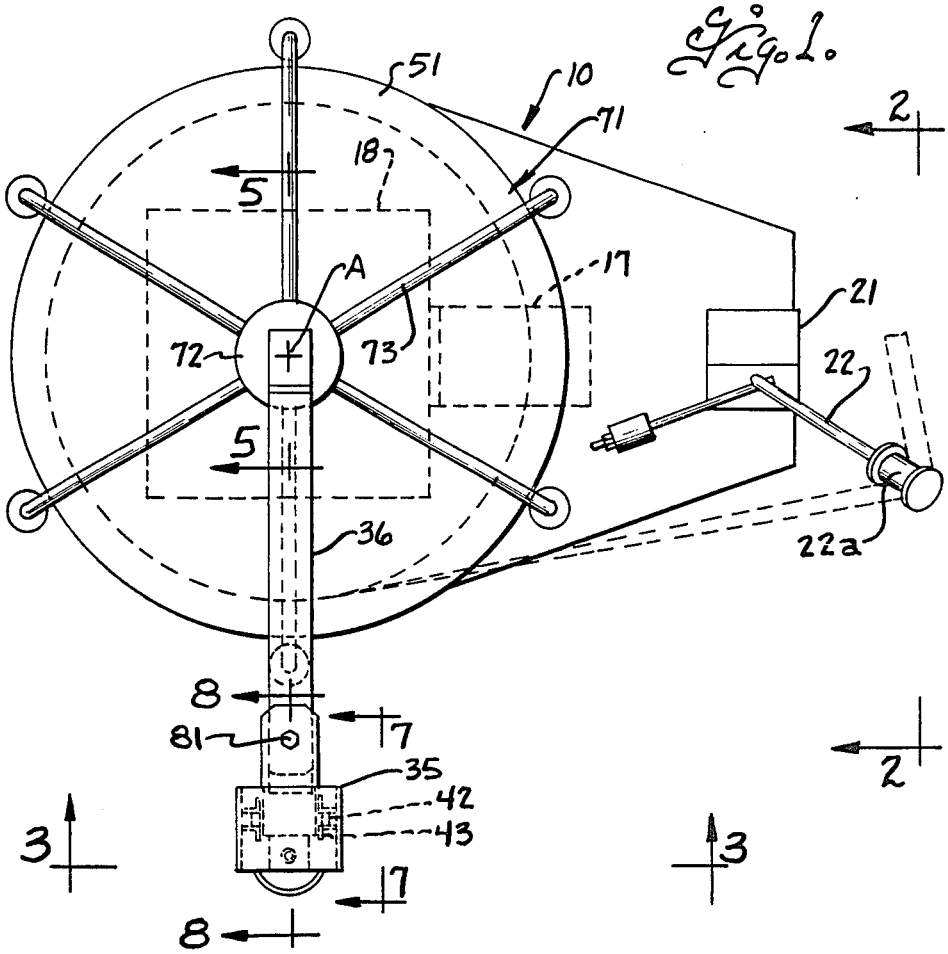
FIG. 1 is a plan view of a vertical axis stock coil feed apparatus according to the present invention.

The vertical axis coil stock feed apparatus has a base 10, conveniently formed by weldments, and including a top wall 11 and depending side walls 12. A horizontal turntable 15 is mounted on the base for rotation about a vertical axis A and is adapted to support coil stock C, with the coil eye upright. Coil stock is commonly shipped with a plurality of coils stacked end-to-end on a pallet P, with the coil axis upright, and the vertical axis coil stock feed apparatus is arranged so that a plurality of stacked coils on a pallet can be loaded on the turntable, and stock from the several coils then fed to a processing machine in sequence beginning with the uppermost coil in the stack. The turntable is preferably power operated and driven by a motor 17 through a speed reducing drive 18 (see FIG. 1). Various conventional motor drive controls can be utilized to control operation of the motor drive to the turntable to feed coil stock from the coil at a rate correlative with the rate at which it is consumed by the subsequent processing machine. In the embodiment illustrated, the motor speed drive control 21 is of the dancer operated type having a dancer arm 22 arranged to engage a loop in the stock intermediate the coil and the subsequent stock processing machine. The dancer operated motor speed control may, for example, be of the type disclosed in U.S. Pat. No. 4,578,621, the disclosure of which is incorporated herein by reference.

Figure 2:
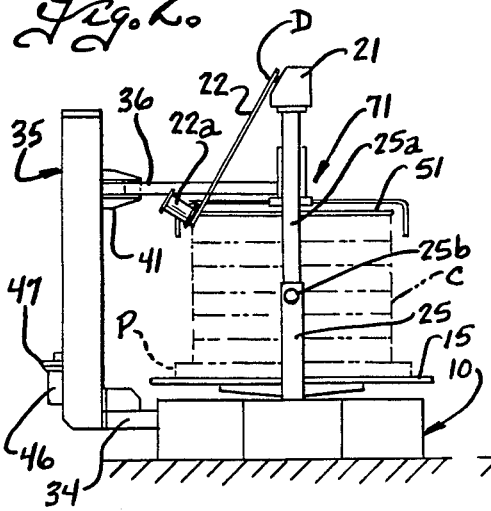
FIG. 2 is a side elevational view taken on the plane 2—2 of FIG. 1 and on a smaller scale than FIG. 1.
Figure 3:
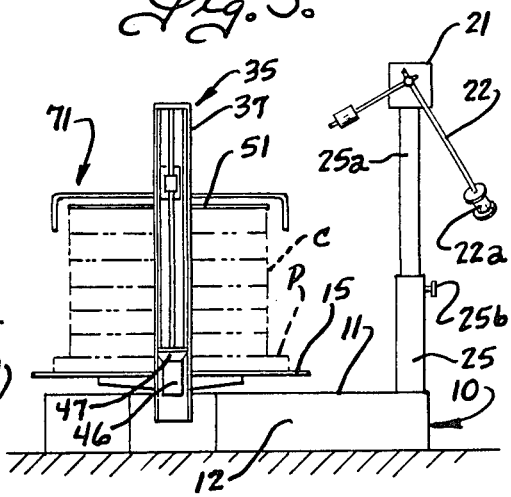
FIG. 3 is a side elevational view taken on the plane 3—3 of FIG. 1 and on a smaller scale than FIG. 1.

In vertical axis coil stock feed apparatus, the stock strip is disposed in an upright plane as it is unwound from the coil. However, most stock processing machines operate on strip stock in a horizontal plane and it is therefore necessary to twist the strip stock from an upright to a horizontal plane as the strip is fed from the coil to the processing machine. As shown in FIGS. 1–3, a stock engaging roller **22*a* is mounted on the dancer arm 22 so as to be inclined both vertically and horizontally, to aid in turning the stock from a vertical plane as it leaves the coil to a horizontal plane as it approaches the stock processing machine. In the embodiment illustrated, the motor speed control 21 is mounted on a post 25 attached to the base and the dancer arm 22 is pivotally mounted on the motor speed control 21 for movement about an axis D that is inclined at an acute angle to a vertical plane through the post 25 and turntable axis A, and the stock engaging roller 22*a* is rotatably mounted on the distal end of the dancer arm for rotation about an axis that is perpendicular to the dancer arm. Thus, the roller axis is inclined both vertically and horizontally. The post 25 is advantageously made vertically adjustable to adjust the dancer arm to accommodate different work processing machines and the upper post section 25*a* is also advantageously adapted for turning movement relative to the lower post section to adapt the feed apparatus for use in different positions relative to the work processing machine. As shown in FIGS. 2 and 3, a means such as a locking screw operated by a knob 25*b*** is provided for locking the upper post section in a vertically and angularly adjusted position relative to the lower post section.

The coil stock, particularly when multiple coils are stacked on the turntable, is relatively heavy and rotation of the coil cannot always be slowed down or stopped as fast as the rate of consumption of the stock by the subsequent wire processing machine is either reduced or stopped. Overrun of the turntable and stock coil reduces the tension on the exiting strip of stock and can allow at least a portion of the outer winding of the coil to move radially and/or axially relative to the coil and result in buckling or tangling of the untensioned length of stock. This problem is aggravated in dispensing relatively resilient strip stock which tends to spring out of a coil when untensioned, somewhat in the manner of a clock spring. Coil stock is fed from the uppermost coil in the stack of coils on the turntable and, in accordance with the present invention, apparatus is provided for controlling movement of the outer winding or windings of the upper coil in the coil stack. As shown in FIGS. 1–4, a support post 35 is mounted as by a bracket 34 on the base 10 and an arm 36 is mounted on the support post for vertical adjustment relative to the base. The support post 35 is herein shown formed by a pair of laterally spaced generally upright plate members 37 that are interconnected by upper and lower headers 38 and 39. A carriage 41 is mounted as by rollers 42 in vertically disposed guideways 43 provided on the inner sides of the plates 37 for vertical movement relative thereto and the arm 36 is mounted on the carriage 41 for vertical adjustment therewith. Power operated means is provided for raising and lowering the arm and, as shown, a lead screw 45 is rotatably supported in the upper and lower headers 38 and 39 and driven by a motor 46 through a speed reducing drive 47. A lead screw follower 48 is fixed to the carriage 41 to effect raising and lowering of the carriage in response to rotation of the lead screw in first and second relatively opposite directions.

Figure 4:
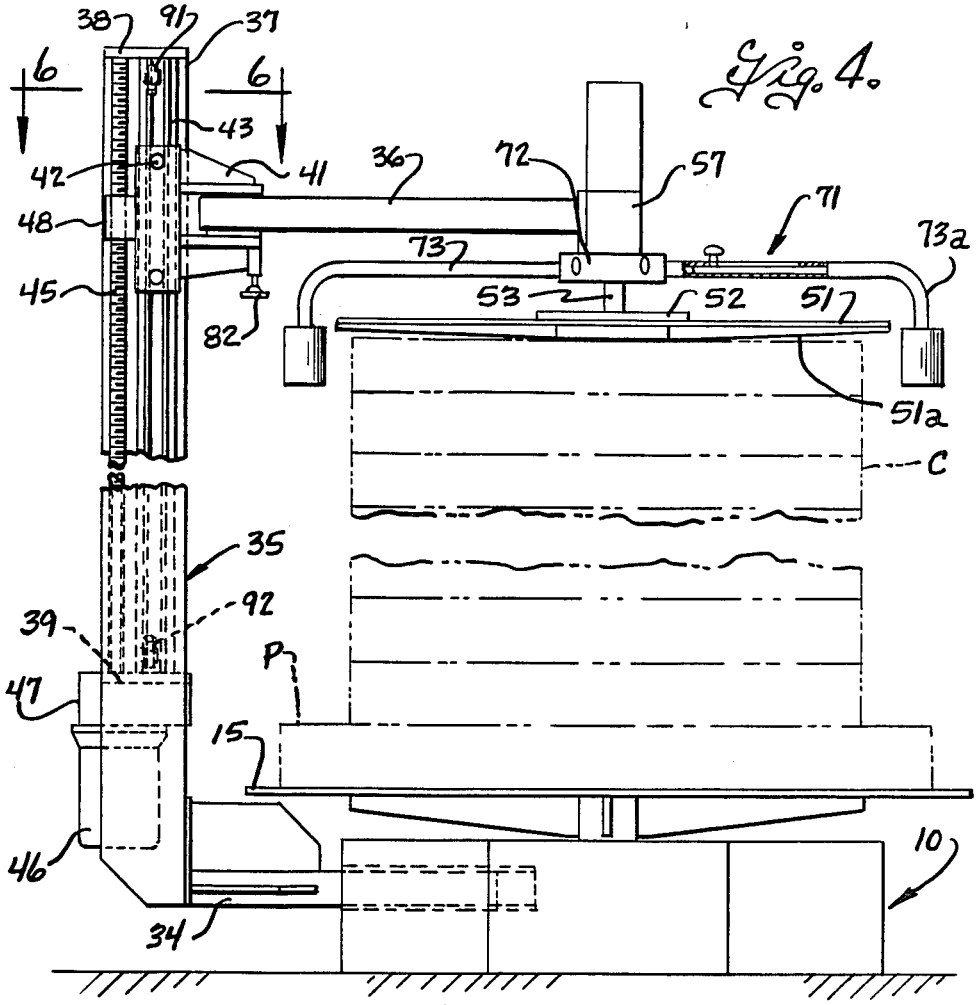
FIG. 4 is a fragmentary side elevational view taken on the plane 2—2 of FIG. 1, with parts broken away and shown in section to illustrate details of construction.
Figure 5:
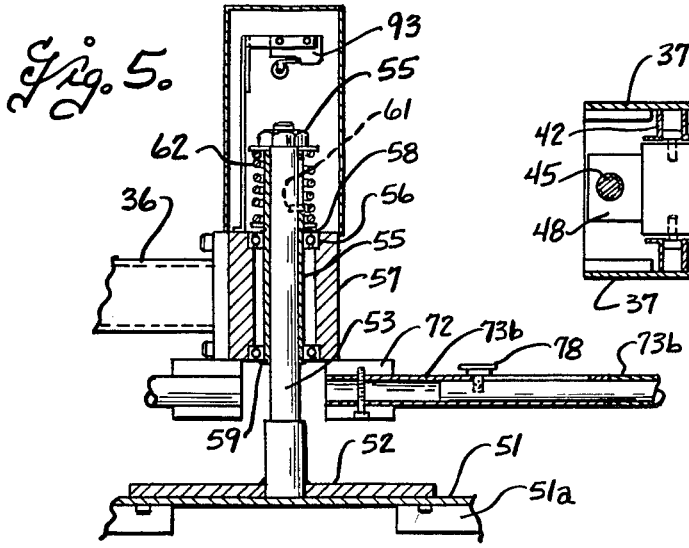
FIG. 5 is a fragmentary sectional view taken on the plane 5—5 of FIG. 1 and illustrating parts on a larger scale than FIG. 1.
Figure 6:
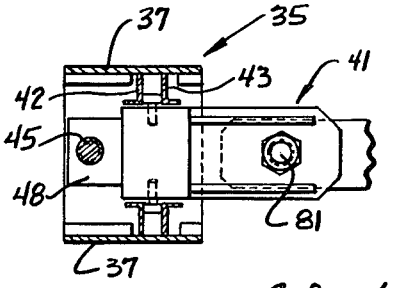
FIG. 6 is a fragementary view taken on the plane 6—6 of FIG. 4.

The arm 36 is adapted to extend into overlying relation to the turntable and a coil cover 51 is mounted on the arm for rotation about an upright axis generally coaxial with the turntable axis A. For reasons pointed out more fully hereinafter, the coil cover is also advantageously mounted for limited vertical movement relative to the arm. As best shown in FIGS. 4 and 5, the coil cover 51 has a central head 52 and a spindle 53 that extends upwardly from the head. A sleeve 55 is rotatably supported by bearings 56 in a hub 57 on the distal end of the arm, and the sleeve is held against axial movement relative to the hub by upper and lower retaining rings 58 and 59. The spindle 53 is slidably supported in the sleeve and a key or dowel pin 61 is provided on the spindle and extends through a vertical slot in the sleeve to constrain the spindle for rotation with the sleeve while allowing the spindle to move vertically relative to the sleeve. A spring 62 is interposed between a washer 63 that engages the retaining ring 58 at the upper end of the hub 57, and a washer 64 at the underside of a nut 55 on the upper end of the spindle, to yieldably urge the spindle and coil cover upwardly. As pointed out more fully hereinafter, the spring rate and length of spring 62 is selected so as to substantially counterbalance the weight of the coil cover. The coil cover is conveniently in the form of an annular disk, it being understood that the coil cover could also be an open construction formed of rods or the like, provided it is sufficiently rigid to inhibit upward movement of the coil windings. As best shown in FIG. 4, a plurality of ribs **51*a* are provided at the underside of the coil cover with the lower side of the ribs inclined upwardly at a shallow angle relative to a plane perpendicular to the axis of rotation of the coil cover. With this arrangement, the underside of the ribs 51*a*** are inclined upwardly at a shallow angle relative to the end face of the uppermost coil in the stack so that the coil cover will contact the uppermost coil adjacent the center of the coil while the outer periphery of the cover is spaced slightly from the end face of the coil to minimize the likelihood of damage to the edge of the strip as it is unwound from the outer periphery of the coil. As shown, the coil cover is formed with an outer diameter sufficiently large to cover the entire upper end of the uppermost coil in the stack on the turntable.

A stationary coil shroud 71 is also mounted on the arm 36 and arranged to extend downwardly around the outer periphery of the coil cover to control radial movement of the outer winding on the upper coil. In the preferred embodiment illustrated in FIGS. 1–4, the coil shroud includes a head 72 fixed to the hub 57 and a plurality of arms 73 that extend outwardly from the hub and have downwardly extending coil retainer portions 73*a* at their outer direction radially of the hub 57, to accommodate coils of different diameter and, as best shown in FIG. 5, the arms include a radially inner tubular section 73*b* fixed as by fasteners 76 to the head 72, and a radially outer tubular section 73*c* having a rod fixed to one end and telescopically received in the tubular section 73*a*. The outer section 73*b* can be adjusted in a direction radially of the hub and then locked in adjusted position as by a thumb screw 78.

The arm 36 is advantageously mounted for movement into and out of position overlying the turntable, to facilitate loading of stock coils on the turntable. As best shown in FIGS. 4 and 6–8, the arm 36 is swingably mounted by a pin 81 on the carriage 41 for movement about a generally upright axis adjacent the support post 35, to enable movement of the distal end of the arm and the coil cover and coil shroud supported thereby, into and out of a position overlying the turntable. A means such as a spring mounted latch pin 82 is mounted on the carriage 41 and arranged to engage a socket or recess in the arm, to releasably latch the arm in an operative position with the axis of the coil cover substantially aligned with the axis of rotation of the turntable.

In order to enable movement of the coil cover and shroud into overlying relation to the coil stack on the turntable, it is necessary to elevate the arm to a level at which the coil cover is above the uppermost coil in the stack. The arm is thereafter lowered to engage the coil cover with the upper end of the uppermost coil in the stack. When the uppermost stock coil is depleted, the arm is again lowered until the coil cover engages the upper end of the next coil, and so on. A control circuit for raising and lowering the coil cover support arm is schemmatically shown in FIG. 9. The motor 47 is of the reversible type and may, for example, be a reversible AC motor having input terminals designated $m_1$, $m_2$, $m_3$, and $m_4$. Upper and lower normally closed limit switches 91 and 92 are mounted on the support post 35 and arranged to be actuated by the carriage 41, when the carriage and support arm reach fully raised and fully lowered positions respectively. A limit switch 93 (FIG. 5) is also mounted on the support arm and arranged to be operated by the spindle 53 on the coil cover, when the coil cover is moved upwardly a preselected distance relative to the arm 36. The control circuit includes lines $L_1$ and $L_2$ adapted for connection to a source of AC power and normally closed lower limit switch 92 and normally closed cover switch 93 are connected in a series circuit with the normally closed contacts 94*a* of a manually operable switch 94 and with the coil of control relay 95 to line 2. Line 1 is also connected in a series circuit that includes normally closed upper limit switch 91, the normally open contacts 94*b* of manually operable switch 94, and the normally closed contacts 96*b* of a manually operable switch 96 to a line designated 97. Line 97 is also connected through the normally open contacts 96*a* of manually operable switch 96 and through the normally closed contacts 94*a* of switch 94 and coil limit switch 93 and upper limit switch 92 to line 1. Line 97 is connected to terminal $m_1$ and is also connected through normally closed relay switches 95*a* of relay 95 to motor terminal $m_3$, and through normally open relay contacts 95*b* of relay 95, to motor terminal $m_4$. Line 2 is connected to motor terminal $m_2$ and through normally closed contacts 95*c* of relay 95 to terminal $m_4$ and through normally open contacts 95*d* of relay 95 to terminal $m_3$. With this arrangement, line 1 and line 2 can be alternately connected to motor terminals $m_3$ and $m_4$ under the control of relay 95, to reverse the phase of the voltage applied to the motor terminals $m_3$ and $m_4$.

When the switches are all in the position shown in FIG. 8, and power is applied to lines 1 and 2, the control relay 95 will be energized to open normally closed contacts 95*a* and 95*c* and close normally closed contacts 95*b* and 95*d*. The motor 46 will not be energized, however, because the normally open contacts 94*b* of of manual switch 94 and normally open contacts 96*a* of manual down switch 96 are open so that power is not applied to motor terminal $m_1$. When the up switch 94 is depressed to open contacts 94*a* and close contacts 94*b*, it interrupts the power to the control relay 95 so that the relay contacts 95*a*–95*b* assume the position shown in FIG. 8. Operation of switch 94 also closes normally open contacts 94*b* to establish a circuit to conductor 97 and to motor terminal $m_1$ to thereby energize the motor 46 and drive lead screw 45 in a direction to raise the arm 36. Raising of the arm can be stopped at any desired position by releasing the manually operable switch 94. However, if the switch 94 is not released before the carriage reaches its upper position, the carriage will open the upper limit switch 91 and stop the motor.

As previously described, when switch 94 is in the position shown in FIG. 8, power is supplied to the control relay 95 and relay contacts 95*a* and 95*c* are opened and relay contacts 95*b* and 95*d* are closed. When the down switch 96 is thereafter operated, it opens normally closed contacts 96*b* and closes contacts 96*a* to apply power to conductor 97. This applies power from line 1 to motor terminal $m_1$ and also applies power from line 1 in the now closed relay contacts 95*b* to motor terminal $m_4$. Power from line 2 is supplied to motor terminal $m_2$ and through now closed relay contacts 95*d* to motor terminal $m_3$ to drive the motor and lead screw in a direction to lower the arm 36. As the arm 36 moves downwardly over a stack of coils on the turntable, the coil cover 51 first contacts the upper end of the uppermost coil in the stack and then moves upwardly until the spindle 53 actuates the coil cover limit switch 93 to an open condition. This interrupts power to the motor 46 and stops downward movement of the coil cover and shroud with the coil cover resting on the uppermost coil in the coil stack. Manually operable switch 96 is thereafter released to return the circuit to the condition shown in FIG. 8.

With the coil cover and shroud arrangement shown in FIGS. 1–5, the coil cover contacts the upper end of the uppermost coil adjacent its inner periphery and the coil cover is spaced slightly from the upper surface of the uppermost coil adjacent its outer periphery so that it does not interfere with or damage the edge of the coil as it is unwound from the uppermost coil in the stack. The coil shroud extends downwardly around the coil cover to a level below the underside of the coil cover to control radial expansion of the outer winding on the upper coil. The downwardly extending portions of the coil shroud are spaced outwardly from the coil so that they do not contact the coil during normal operation, and only inhibit radial movement of the outer winding of the coil when the tension on the exiting strip is relaxed. This is important in handling soft and light weight materials to minimize the likelihood of kinking or deforming of the material. However, in heavy weight and resilient materials, such as some heavier weight steel stock, provision can be made for pressing the outermost winding of the upper coil against the coil body to inhibit radial expansion of the coil. As shown in FIG. 10, a roller or shoe 110 is mounted on the outer section 73*a* of one of the arms 73 of the shroud for movement relative thereto in a horizontal direction toward the outer periphery of the uppermost coil on the stack, and is yieldably biased as by a spring 113 against the coil.

From the foregoing it is thought that the construction and operation of the vertical axis coil stock feed apparatus will be readily understood. The coil cover and shroud can be raised and moved into a position overlying the coil stack on the turntable and then lowered to engage the coil cover with the upper end of the coil in the stack. The coil cover inhibits upward movement of the outer windings of the coils in the event the tension on the exiting strip is released and, since the coil cover rotates with the coils, it does not scuff or deform the edges of the coil strips. The spring 62 counteracts the weight of the coil cover and the spring rate and length are selected in relation to the weight of the coil cover and position the coil limit switch 93 to control the pressure applied by the coil cover to the upper end of the coil in the stack. The coil shroud has portions that extend downwardly around the outer periphery of the uppermost coil to control radial expansion of the outer winding of the coil in the event the tension on the exiting strip is relieved.

The embodiment of the invention in which an exclusive property or privilege is claimed are defined as follows:

1. Apparatus for feeding strip material from wound coil stock means having a coil eye and opposite ends to a processing station comprising, a base, a turntable mounted on the base for rotation about a vertical axis and adapted to support coil stock means with the coil eye upright, support post means mounted on the base and extending upwardly therefrom at a location outwardly of the turntable, an arm mounted on the support post means for vertical adjustment relative to the base and extending from the post above the turntable, a coil cover mounted on the arm for rotation relative thereto about a vertical axis generally coaxial with the turntable axis and adapted to engage an upper end of a coil stock means on the turntable for limiting upward movement of coil winding, and a stationary coil shroud mounted on the arm and having means extending downwardly to a level below the coil cover for limiting radial movement of coil windings.

2. Apparatus for feeding strip material according to claim 1 wherein said coil cover is supported for limited vertical movement relative to said arm.

3. Apparatus for feeding strip material according to claim 1 wherein said coil cover is supported for limited vertical movement relative to said arm, and electroresponsive means actuated in response to a preselected vertical movement of said coil cover relative to said arm.

4. Apparatus for feeding strip material according to claim 1 wherein the coil cover is supported for limited vertical movement relative to the arm, and spring means interposed between the arm and the coil cover for at least partially counterbalancing the weight of the coil cover.

5. Apparatus for feeding strip material according to claim 1 including power operated means operable to effect vertical adjustment of said arm relative to the base, said coil cover being mounted on the arm for limited vertical movement relative thereto, and control means including means responsive to a preselected vertical movement of said coil cover relative to said arm for controlling operation of said power operated means.

6. An apparatus for feeding strip material according to claim 1 wherein said arm is mounted on said post for movement relative thereto to enable movement of said coil cover and shroud into and out of a position above said turntable.

7. An apparatus for feeding strip material according to claim 1 wherein said arm has one end mounted on said post for swinging movement about a generally upright axis to enable movement of said coil cover and shroud into and out of a position overlying said turntable.

8. An apparatus for feeding strip material from wound coil stock means having a coil eye and opposite ends to a processing station comprising, a base, a turntable mounted on the base for rotation about a vertical axis and adapted to support a coil stock means with the coil eye upright, support post means mounted on the base and extending upwardly therefrom at a location outwardly of the turntable, an arm mounted on the support post means for vertical adjustment relative to the base and extending from the post above the turntable, power operated means for vertically adjusting said arm relative to said base, a coil cover mounted in the arm for rotation about an axis generally coaxial with the turntable axis and for limited vertical movement relative to the arm, and control means including means responsive to a preselected vertical movement of the coil cover relative to the arm for controlling operation of said power operated means.

9. An apparatus for feeding strip material according to claim 8 wherein said control means includes a first selectively operable means for operating said power operated means to adjust the arm upwardly away from the base and a second selectively operable means for operating said power operated means to adjust the arm downwardly toward the base, said means responsive to a preselected vertical movement of said coil cover being operative to limit downward adjustment of the arm.

10. An apparatus for feeding strip material according to claim 8 wherein said arm is mounted on the post for movement into and out of a position above the turntable.

11. An apparatus for feeding strip material according to claim 8 wherein said arm is mounted on said post for swinging movement about an upright axis into and out of a position above the turntable.

12. An apparatus for feeding strip material according to claim B including a stationary coil shroud mounted on the arm and having means extending downwardly to a level below the coil cover for limiting radial movement of coil windings.

13. An apparatus for feeding strip material according to claim 12 including roller means mounted on the coil shroud and yieldably biased in a horizontal direction to engage the outer periphery of a coil stock means on the turntable.

14. An apparatus for feeding strip material according to claim 8 including spring means interposed between the arm and the coil cover for yieldably urging the coil cover upwardly to at least partially counterbalance the weight of the coil cover.

* * * * *